US011891770B2

(12) United States Patent
Hargrave et al.

(10) Patent No.: US 11,891,770 B2
(45) Date of Patent: Feb. 6, 2024

(54) CATENARY PANEL RETAINING WALL

(71) Applicant: CMI LIMITED CO., Marietta, GA (US)

(72) Inventors: Steve Hargrave, Roswell, GA (US); Keith Panik, Ball Ground, GA (US)

(73) Assignee: CMI LIMITED CO., Marietta, GA (US)

( * ) Notice: Subject to any disclaimer, the term of this patent is extended or adjusted under 35 U.S.C. 154(b) by 0 days.

(21) Appl. No.: 17/717,183

(22) Filed: Apr. 11, 2022

(65) Prior Publication Data

US 2022/0325494 A1 Oct. 13, 2022

Related U.S. Application Data

(60) Provisional application No. 63/173,821, filed on Apr. 12, 2021.

(51) Int. Cl.
*E02D 29/02* (2006.01)

(52) U.S. Cl.
CPC ..... *E02D 29/0225* (2013.01); *E02D 29/025* (2013.01)

(58) Field of Classification Search
CPC ..... E02D 29/0225; E02D 29/025; E02D 29/0266; E02D 5/08
See application file for complete search history.

(56) References Cited

U.S. PATENT DOCUMENTS 2,453,609 A * 11/1948 Whitehouse ..... E02D 29/0266 52/107
3,316,721 A * 5/1967 Heilig ..... E02D 29/0266 47/33
4,050,254 A 9/1977 Meheen et al.
4,341,491 A * 7/1982 Neumann ..... E02D 29/0233 405/262
4,407,612 A * 10/1983 van Weele ..... E02D 5/20 405/285
4,707,962 A * 11/1987 Meheen ..... E02D 29/0216 52/565
D299,170 S * 12/1988 Meheen ..... D25/113
4,917,543 A * 4/1990 Cole ..... E02D 29/0266 405/262
5,107,640 A * 4/1992 Gefroh ..... E04F 17/06 52/107

(Continued)

FOREIGN PATENT DOCUMENTS

CN 2871651 Y 2/2007
CN 202298650 U 7/2012

(Continued)

*Primary Examiner* — Carib A Oquendo
(74) *Attorney, Agent, or Firm* — GARDNER GROFF & GREENWALD, PC

(57) ABSTRACT

A retaining wall system, retaining wall panel, and method of constructing a retaining wall, wherein panels of the retaining wall define an arched or curved profile in plan view, for example following a catenary curvature, with the wall panel curvature being concave in a direction extending into the backfill area behind the retaining wall. The curvature resists backfill loading on the panel and evenly distributes the load across the panel without significant stress concentrations and transfers the load to posts or columns to which the panels are mounted.

14 Claims, 5 Drawing Sheets

(56) References Cited

U.S. PATENT DOCUMENTS

| | | | | |
|---|---|---|---|---|
| 5,360,296 | A * | 11/1994 | Angelette | E02D 29/0266 405/285 |
| 7,997,830 | B2 * | 8/2011 | Wendt | E02D 5/04 405/285 |
| 2018/0313050 | A1 * | 11/2018 | Jeanmarie | E02D 5/08 |
| 2021/0002845 | A1 * | 1/2021 | Jones | E02D 29/0266 |

FOREIGN PATENT DOCUMENTS

| | | | |
|---|---|---|---|
| CN | 102296620 | B | 12/2013 |
| CN | 104499502 | B | 6/2016 |
| CN | 107090848 | A | 8/2017 |
| CN | 107740426 | A | 2/2018 |
| CN | 108385715 | A | 8/2018 |
| CN | 112031003 | A | 12/2020 |
| JP | 2787806 | B2 | 8/1998 |
| KR | 101065017 | B1 | 9/2011 |
| WO | 2001011147 | A1 | 2/2001 |

* cited by examiner

CATENARY PANEL RETAINING WALL

CROSS-REFERENCE TO RELATED APPLICATION

This application claims the benefit of U.S. Provisional Patent Application Ser. No. 63/173,821 filed Apr. 12, 2021, the entirety of which is hereby incorporated herein by reference for all purposes.

TECHNICAL FIELD

The present invention relates generally to the field of retaining walls, and more particularly to a retaining wall system and retaining wall panels having an arcuate or curved profile, and in particular examples having a catenary curve profile.

BACKGROUND

Various forms and manners of construction of retaining walls are used to hold back soil and other substrates on terraces or embankments, for landscaping, soil stabilization, structural support, and other purposes. For example, typical planar retaining walls utilize gravity and mass to hold back soil. Retaining walls consisting of stacked stone or block, concrete walls, wood walls, and sheet piling walls are known. Many known retaining walls may involve high labor costs and longer than desired installation times. The heavy materials of many types of retaining walls are not well-suited to do-it-yourself (DIY) type installations by homeowners or landscape professionals without heavy equipment.

Accordingly, it can be seen that needs exist for improved retaining walls, retaining wall components, and methods of retaining wall construction. It is to the provision of improved retaining walls, retaining wall components, and methods of retaining wall construction meeting these and other needs that the present invention is primarily directed.

SUMMARY

In example embodiments, the present invention provides improved retaining walls, retaining wall components, and methods of retaining wall construction. In example embodiments, the wall system can be installed faster than a traditional stacked stone or block wall, with less labor. In example embodiments, the material costs are less than that of concrete or stacked stone/block walls. In example embodiments, the system can be a do-it-yourself (DIY) retaining wall solution suited for installation by homeowners or contractors without the need for heavy equipment.

In one aspect, the present invention relates to a retaining wall system including a plurality of support posts arranged in a spaced array, and at least one wall panel configured for engagement between a first support post and a second support post. The at least one wall panel preferably has a plan profile defining a curvature, and in particular examples the curvature profile defines a catenary curve.

In another aspect, the invention relates to a panel for a retaining wall. In example forms, the panel preferably includes a front face, a back face, a top edge, a bottom edge, a first side edge and a second side edge. The panel preferably defines a plan profile from a top perspective having an arched curvature, for example following a catenary curve.

In still another aspect, the invention relates to a method of constructing a retaining wall. The method preferably includes installing a plurality of posts anchored in or to the ground in a spaced array and mounting at least one wall panel between adjacent pairs of the plurality of support posts. The at least one wall panel preferably has a plan profile defining a curvature, for example a catenary curve.

These and other aspects, features and advantages of the invention will be understood with reference to the drawing figures and detailed description herein and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
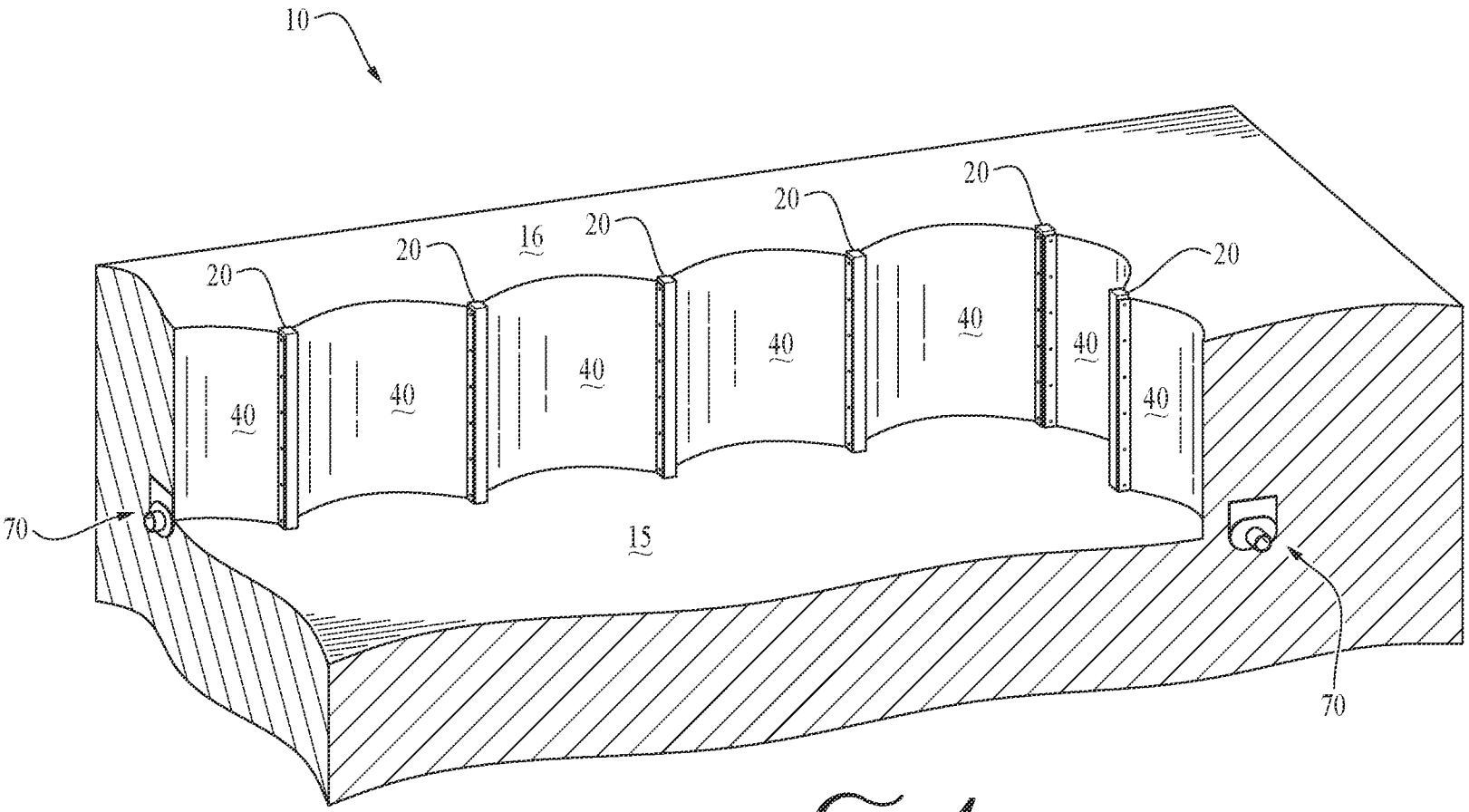
FIG. 1 is a perspective view of a retaining wall system according to an example embodiment of the present invention.

With reference now to the drawing figures, wherein like reference numbers represent corresponding parts throughout the several views, FIG. 1 shows a retaining wall system 10 according to one example embodiment of the invention. The retaining wall system 10 generally includes a plurality of generally upright or vertical posts, pilings, or columns 20, and one or more wall panels 40 extending between adjacent posts 20.

The posts 20 may be installed in a spaced array, with their lower ends buried in, or otherwise anchored to the ground 15, which may be at a lower elevation in front of the wall than the higher elevation or backfill 16 behind the wall. In particular examples, backfill 16 elevation level may reach part way up the height of the panels 40. In other examples, the backfill grade 16 may reach the top height of the panels 40.

The posts 20 may be arrayed in linear, curved, or other fashion, generally following the path of the retaining wall to be constructed. Adjacent posts 20 may be spaced from one another at regular intervals. In some examples, the spacing between posts 20 may be between about 3' (36") to 8' (96"). In other embodiments, the spacing between posts 20 may be between about 3' (36") to 6' (72"). In particular embodiments, the spacing between posts 20 may be about 3' (36"), 4' (48"), or 5' (60"). In further examples, the spacing may be between about 42" to 48". In particular examples, the spacing between posts 20 may be 44".

Figure 2:
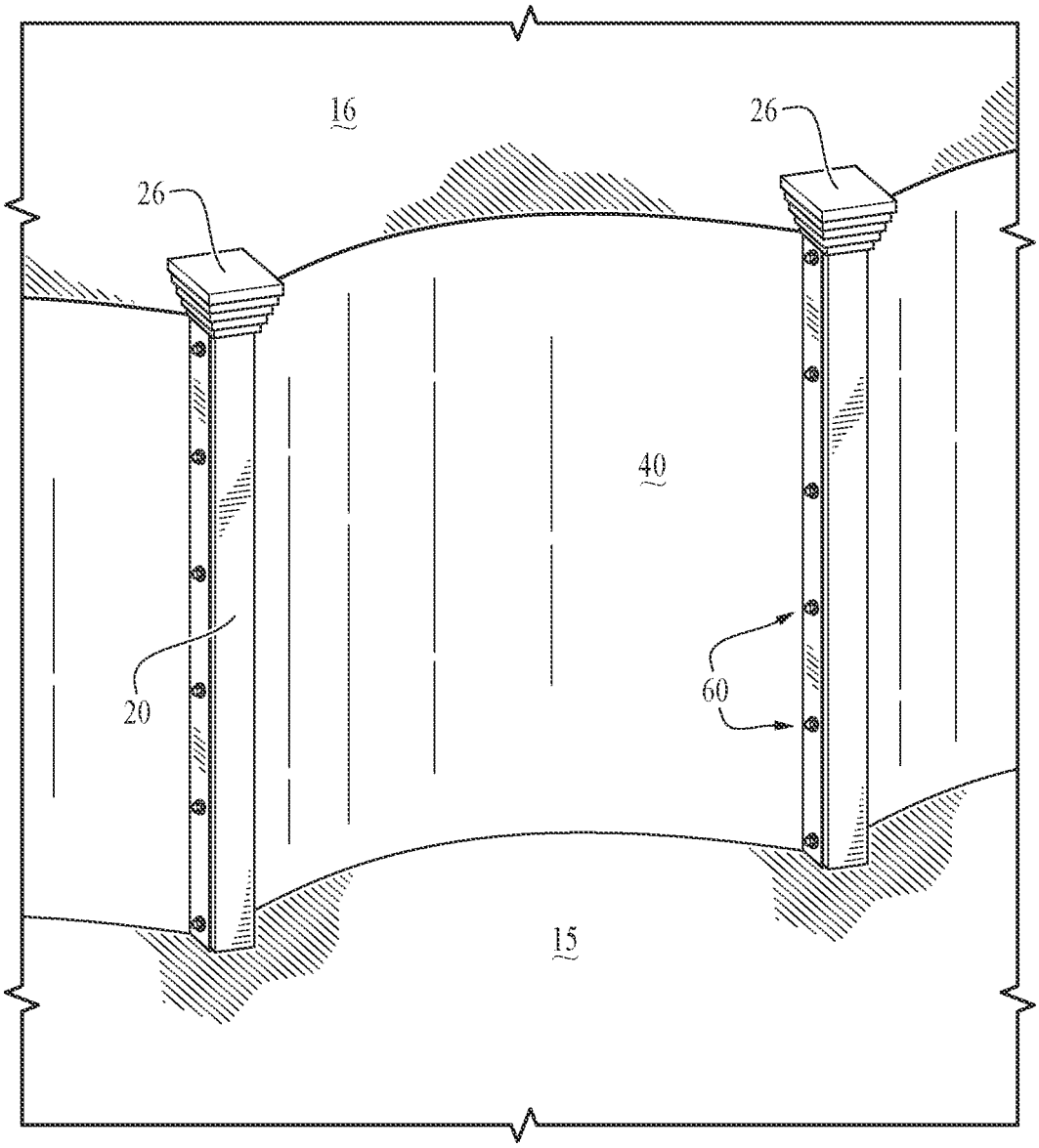
FIG. 2 is a detailed view of a section of the retaining wall system of FIG. 1, according to an example embodiment.
Figure 5:
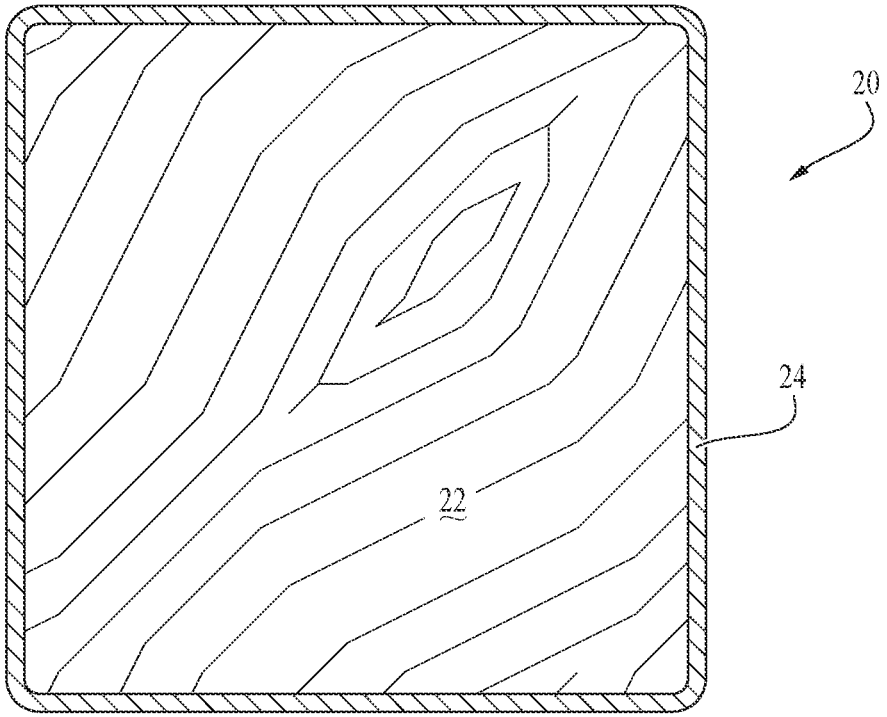
FIG. 5 shows an example post or piling component of a retaining wall system according to an example embodiment of the present invention.

Posts 20 may be made from any suitable material and in any suitable shape. In example embodiments, the posts 20 may comprise wooden posts, for example 4×4, 6×6, or other nominal dimension pressure treated lumber. In alternate embodiments, for example as shown in FIGS. 5A and 5B (collectively FIG. 5), the posts 20 may comprise an inner core 22 of wood with an outer cladding 24 of weather-resistant polymeric material such as polyvinyl chloride (PVC), vinyl or other plastics or polymers, such as for example TimberGuard® polymer encapsulated treated wood posts or pilings sold by CMI Limited Co. (https://www.cmilc.com/products/timberguard-treated-wood). In alternate embodiments, the posts 20 may comprise poles, columns or beams of steel, aluminum or other metals; plastic or polymeric members; stone, concrete or masonry columns; or other vertical or generally upright structural members. Optionally, the posts 20 may include finials or caps 26 and/or other decorative and/or functional components as shown in FIG. 2.

Figure 4C:
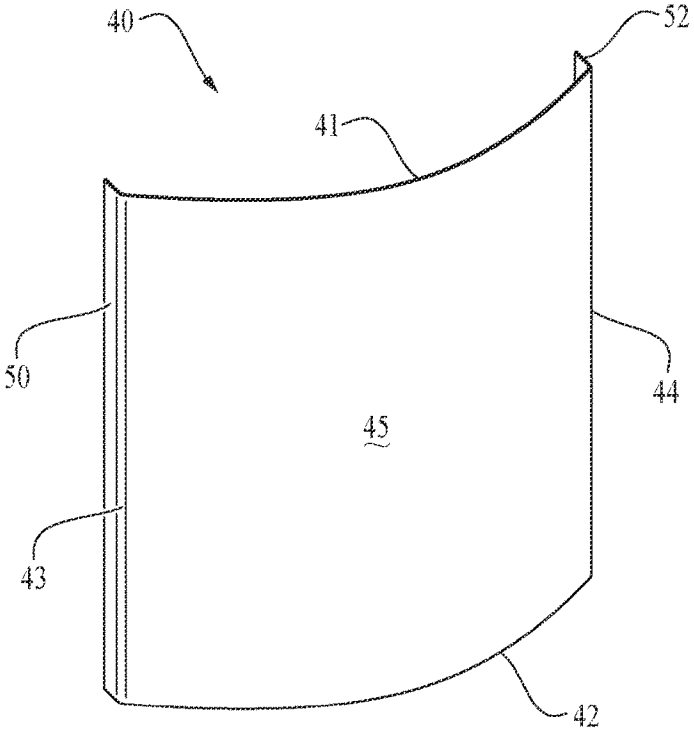
FIG. 4 (4A, 4B, and 4C) shows details of a retaining wall panel according to an example embodiment of the present invention.
Figure 4A:
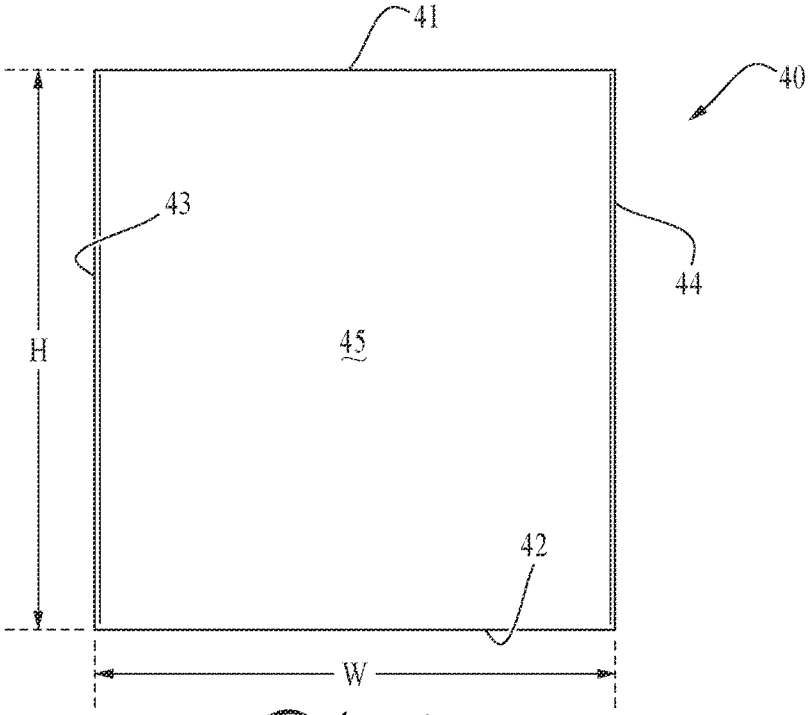

As seen throughout FIG. 4, the panels 40 may have a top edge 41, a bottom edge 42, a first side edge 43, a second side edge 44, a front face 45, and a back face 46. In elevational view (i.e., viewed from the front or back), as seen with reference to FIG. 4A, in example embodiments the panels 40 may be generally rectangular or square. The panels 40 define a height H between the top edge 41 and the bottom edge 42, a width W between the first side 43 and second side 44, and a material thickness T between the front face 45 and back face 46. In example embodiments, the panel height H may be between about 1' to about 12' high, and in particular examples between about 3' to about 8' high. The panel width W generally corresponds to the spacing between the posts 20. For example, if the center-to-center distance of two 4×4 posts is 48", the actual panel width would be 44.5". Optionally another ¼" or more may be added to the panel width W (for example about 44.75") to ensure that the panel touches the inside of the posts. The thickness T may be any suitable thickness. In example embodiments, the material thickness T may be about ⅛" to ½".

In example embodiments, the panels 40 may comprise rigid or semi-rigid materials. In some embodiments, the panels 40 may be comprised of plastics, thermoset composite, fiber-reinforce plastic (FRP), and/or thermoplastic composite materials. In other embodiments, the panels 40 may be formed of vinyl, polyvinyl chloride (PVC), steel, aluminum or other metals, composites, or other materials of construction. In example forms, the panels 40 may be constructed of materials providing a degree of elasticity, allowing some flexure under load, and optionally having a shape-memory to bias the panels 40 against a load and back toward their unflexed state.

The panels 40 may comprise attachment flanges 50, 52 along their first side 43 and second side 44 for attachment to posts 20. The attachment flanges 50 and 52 may optionally be pre-drilled with holes for receiving fasteners 60 to attach the panels 40 to the posts 20.

Figure 4B:
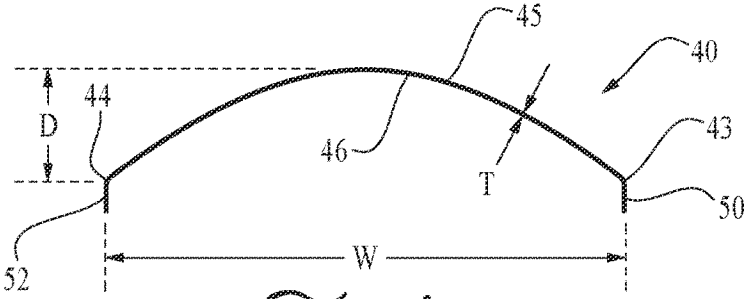

In plan view (i.e., viewed from the top or bottom), as seen with reference to FIG. 4B, the panels 40 are curved between the first side 43 and second side 44 with an arcuate, arched or generally U-shaped curvature, with the concavity of the panels' curvature extending rearward, in the direction of the backfilled area behind the retaining wall (i.e., central portions of the panels between the posts extend further back into the backfill area than at side edges of the panels where the panels are attached to the posts as shown in FIG. 1), whereby the curvature of the wall panels resists the load or pressure resulting from the backfill. In example embodiments, the panels 40 are extruded, molded or otherwise formed to have a catenary profile, in which the concavity extends into backfill 16. In some examples the panels 50 have a catenary curve with a depth profile according to the equation:

$$y = \left[\frac{c1}{2} * \left(e^{x/c2} + e^{-x/c2}\right)\right] + c3$$

where C1, C2 & C3 are constants, x is in the direction of the width W, and y is in the direction of depth D described below. In example embodiments the constants may be chosen to optimize the curve for the widths between posts 20 (nominally, 3', 4', 5', etc.). In example embodiments, the catenary sheet panel 40 may be formed to have the catenary curvature in its natural unbiased equilibrium state without any load applied. In other embodiments, the panel 40 may be formed to elastically deform into the catenary curvature when a load is applied, for example the anticipated load of fill or soil backfill 16 loading behind the wall system when in use. In some embodiments, panels 40 may be preformed in the catenary shape before installation. In other embodiments, the panels 40 may be fabricated as flat sheets or panels of flexible material, and later bent into the catenary shape during installation by flexing panels having a width greater than the spacing between adjacent posts and affixing the panels in compression in the flexed state between posts 20.

The curved profile of the panels 40 may result in a curvature depth D (the front-to-back distance from a first line extending between the first side 43 and second side 44 of the panel 40 to a parallel second line tangent with the point on the panel furthest from the first line, generally at the midpoint of the panel's 40 width and at or adjacent the inflection point or apex of the panel's 40 curvature), as indicated in FIG. 4B. In example embodiments the depth of curvature "D" may be determined by the constants which are chosen to optimize the curve for the widths between adjacent posts 20 (nominally, 3', 4', 5', etc.). The depth D may provide stiffness and strength to the panel 40 to resist forces applied by the backfill 16 loading behind the retaining wall system 10.

The catenary or curved profile of the catenary sheet or panel 40 allows the load or pressure applied by backfill 16 behind the retaining wall system 10 to be distributed across the panels 40 and to the posts 20. By contrast, C-channel, S-channel or other previously known types or profiles of retaining wall panels may concentrate stress loads on and around the center face lying roughly perpendicular to the load, and/or at one or more discontinuities or points of curvature along the panel profiles. In contrast, the catenary sheet allows the load to be distributed over a wider area, resulting in a more even stress distribution and avoiding localized stress concentrations on the panel.

In example installations and modes of use, the backfill 16 load biases the panels 40 toward a flatter curvature profile against the shape memory of the material, whereby the internal stress within the panel's 40 material resists deformation by the backfill 16 load. Also, the biasing of the panel 40 toward a flatter curvature profile may cause the side-to-side width of the panel 40 to expand, pressing the sides edges of the panel 40 against the support posts 20, to provide support against the backfill 16 load. Support posts 20 not at the ends of the wall will typically receive a side or transverse load from a first panel 40 on a first side of the post 20, and a generally equal but opposed or oppositely-directed side or transverse load from a second panel 40 on an opposite second side of the post 20, whereby the post 20 is held in generally equilibrium or balanced compression loading from opposite sides by the adjacent panels. In this manner, the panel and post components of the wall work together to distribute and support the soil load behind the wall. Optionally, posts at the ends of a wall system may be larger and/or more deeply embedded than intermediate posts, or may be otherwise reinforced, in order to resist the unbalanced load from a panel on one side of the post.

Otherwise defined, the panels 40 may utilize the geometry of a catenary shape which translates outward forces into transverse forces allowing a "thin" panel 40 or part to do the work of a "thick", planar, retaining wall. The catenary shape generally corresponds to the curve that an idealized hanging chain or cable assumes under its own weight when supported only at its ends. Without being bound by theory, catenary arches or structures as disclosed herein are understood to provide superior strength because they redirect the force applied on the arch of the structure into compression forces pressing along the arch's curve, and in a uniformly loaded catenary arch, the line of thrust runs through its center.

Figure 6:
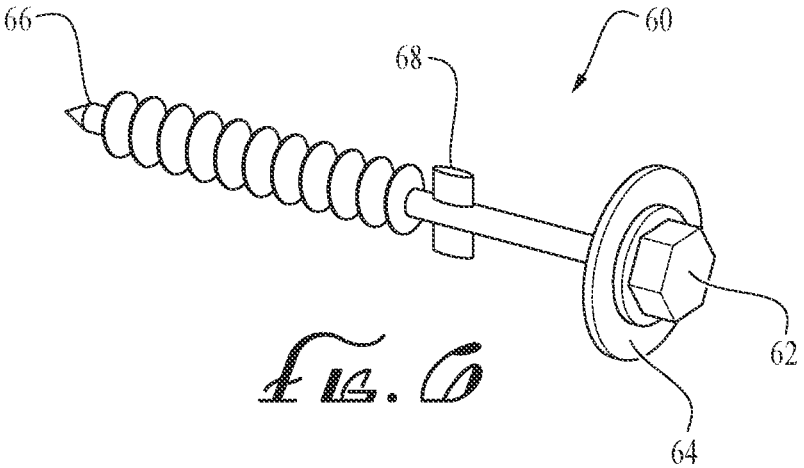
FIG. 6 shows an attachment screw fastener component of a retaining wall system according to example embodiments of the present invention.

The retaining wall system 10 optionally further comprises a plurality of fasteners 60 for attachment of the panels 40 to the posts 20, for example along the attachment flanges 50, 52 of the panels 40. In example forms, the fasteners 60 may comprise bolts, screws, or other threaded fasteners, nails, clips, slots, or other retainers. In particular embodiments, the fasteners 60 may comprise 2" (or other length) stainless steel (or other material) lag bolts. In further examples, such as the example shown in FIG. 6, the bolts may have painted heads 62 that match the colors of the panels 40 and/or the posts 20. The fasteners 60 may include a washer 64 to spread the attachment load, a self-drilling drill point tip 66, and/or wings 68 to make the hole in the plastic of the panel 40 a bit larger to allow for some expansion/contraction from temperature changes, loading or otherwise. Other fastener types can be used. In some embodiments the fastener head has a built-in washer to spread the load.

Figure 3A:
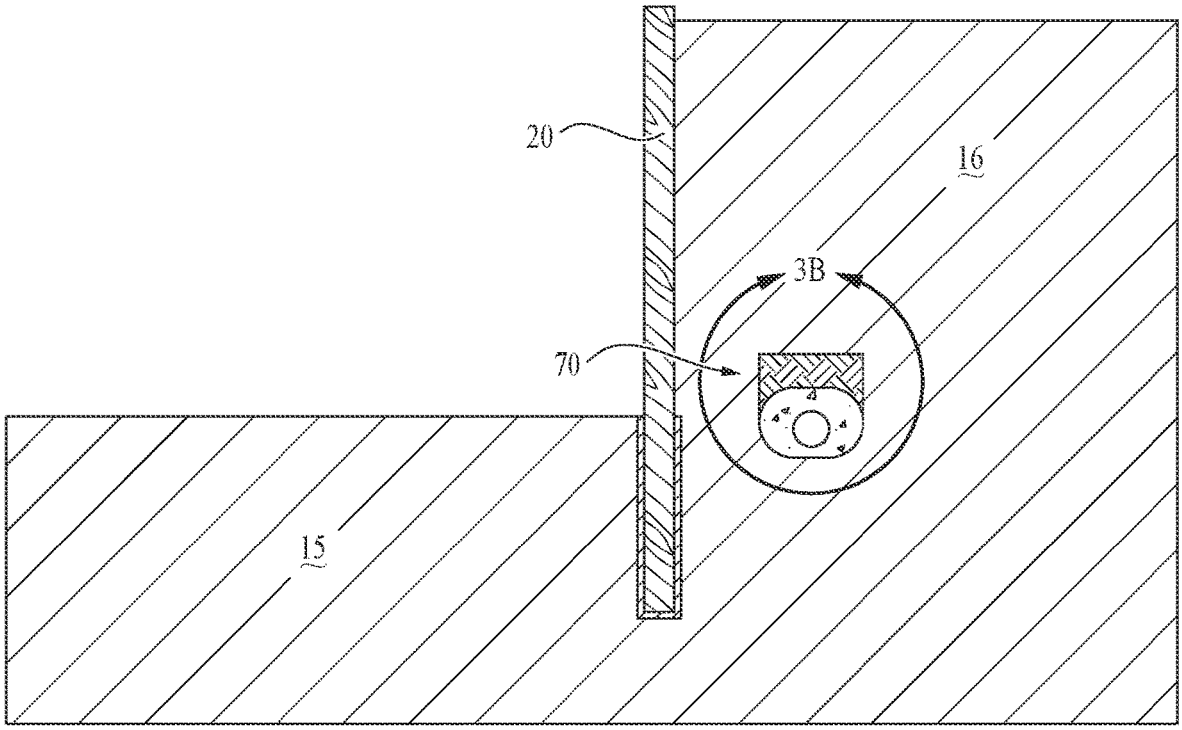
FIG. 3 (3A and 3B) shows additional details of a retaining wall drainage system according to an example embodiment of the present invention.
Figure 3B:
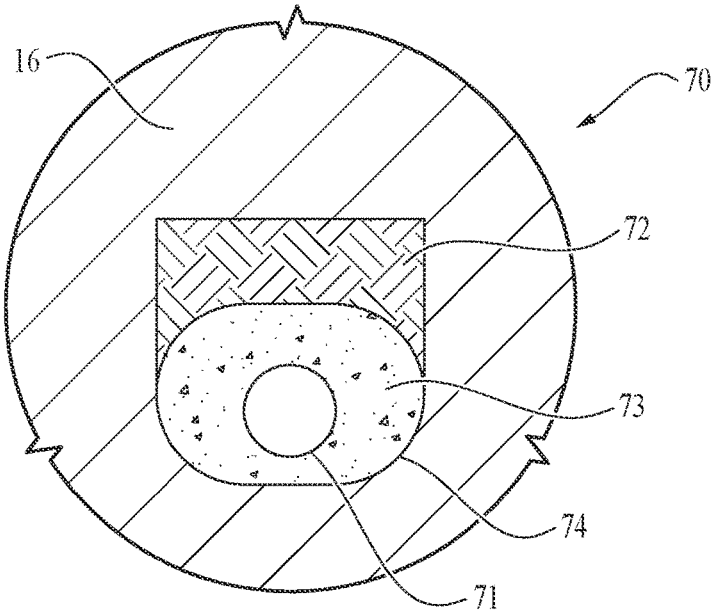

The retaining wall system 10 optionally further comprises a drainage system 70, shown in example form in FIGS. 3A and 3B (collectively FIG. 3), for draining groundwater from behind the retaining wall to reduce hydrostatic loading. In example forms, the drainage system may comprise corrugated/perforated and/or solid piping 71, gravel 72, drain rock 73, and/or geotextile fabric components 74.

Example embodiments of the invention may also include a method of constructing a retaining wall. The method may include digging or drilling post holes in the ground 15 and installing the posts 20 in the holes. Alternatively, the posts 20 may be driven or otherwise inserted into the ground 15. In example forms, the posts 20 are embedded to a depth of roughly one third to one half the exposed height of the wall. In alternate embodiments, the wall panels 40 are not embedded or driven into the ground 15, but instead are installed above grade, and backfilled behind the wall. The posts 20 are spaced in an array along the desired path of the wall. The spacing between posts 20 generally corresponds to width W of the panels 40 to be installed (for example on 4', 5', or 6' centers). The posts 20 may be anchored by filling the post holes with dirt or filling with concrete and allowing the concrete to cure.

Panels 40 having a curved profile, for example according to the catenary equations above, may be attached between the posts 20. The posts 20 are kept plumb and aligned during the attachment process, optionally with bracing or other supports. The catenary sheet panels 40 may be fastened to the posts 20 with fasteners such as bolts 60. Drainage pipe system 70 may optionally be installed behind and at bottom of wall and covered with filter cloth 74 and stone 73. Earth or gravel 72 is backfilled behind the wall. Decorative post caps 26 or other components may be installed on the posts 20 and/or panels 40, if desired.

While the invention has been described with reference to example embodiments, it will be understood by those skilled in the art that a variety of modifications, additions and deletions are within the scope of the invention, as defined by the following claims.

What is claimed is:

1. A retaining wall system comprising:

a plurality of support posts arranged in a spaced array; and at least one wall panel configured for engagement between a first support post and a second support post, the at least one wall panel having a plan profile defining a curvature, wherein the curvature profile of the at least one wall panel defines a catenary curve.

2. The retaining wall system of claim 1, wherein the support posts comprise a wood core and a polymeric cladding.

3. The retaining wall system of claim 1, further comprising decorative caps for attachment to the support posts.

4. The retaining wall system of claim 1, further comprising a plurality of fasteners for attachment of the wall panels to the support posts.

5. A panel for a retaining wall, the panel comprising a front face, a back face, a top edge, a bottom edge, a first side edge, a second side edge, and attachment flanges extending along the first and second side edges of the panel, wherein the panel defines a plan profile from a top perspective having an arched curvature.

6. The panel of claim 5, wherein the arched curvature of the panel profile defines a catenary curve.

7. The panel of claim 5, comprising a material of construction selected from the group comprising plastic, thermoset composite, fiber-reinforced plastic (FRP), vinyl, polyvinyl chloride (PVC), steel, aluminum, other metals, composites, and combinations thereof.

8. A method of constructing a retaining wall, said method comprising:

installing a plurality of posts anchored in or to a ground in a spaced array; and mounting at least one wall panel between adjacent pairs of the plurality of support posts, the at least one wall panel having a plan profile defining a curvature, wherein the curvature profile of the at least one wall panel defines a catenary curve.

9. The method of claim 8, further comprising backfilling behind the at least one wall panel.

10. The method of claim 8, further comprising installing a drainage system behind the at least one wall panel.

11. A retaining wall system comprising:

a plurality of support posts arranged in a spaced array; and at least one wall panel configured for engagement between a first support post and a second support post, the at least one wall panel having a plan profile defining a curvature in the shape of a catenary curve corresponding to a formula $$y = \left[\frac{C_1}{2}\left(e^{\frac{x}{C_2}} + e^{-\frac{x}{C_2}}\right)\right] + c_3.$$

12. The retaining wall system of claim 11, wherein constants $C_1$, $C_2$, and $C_3$ are all the same.

13. The retaining wall system of claim 11, wherein constants $C_1$, $C_2$, and $C_3$ are all different.

14. The retaining wall system of claim 11, wherein two of constants $C_1$, $C_2$, and $C_3$ are the same.

* * * * *